United States Patent [19]

Chibana

[11] 4,103,582

[45] Aug. 1, 1978

[54] ELECTRONIC MUSICAL INSTRUMENT

[75] Inventor: Masanobu Chibana, Hamamatsu, Japan

[73] Assignee: Nippon Gakki Seizo Kabushiki Kaisha, Hamamatsu, Japan

[21] Appl. No.: 780,752

[22] Filed: Mar. 24, 1977

[30] Foreign Application Priority Data

Apr. 2, 1976 [JP] Japan ..... 51/36756

[51] Int. Cl.[2] ..... G10H 1/02

[52] U.S. Cl. ..... 84/1.24; 84/1.11; 84/1.19

[58] Field of Search ..... 84/1.01, 1.03, 1.11, 84/1.12, 1.19, 1.21, 1.22, 1.24, 1.25

[56] References Cited

U.S. PATENT DOCUMENTS

| | | | |
|---|---|---|---|
| 3,809,790 | 5/1974 | Deutsch | 84/1.01 |
| 3,888,153 | 6/1975 | Deutsch | 84/1.01 |
| 3,908,504 | 9/1975 | Deutsch | 84/1.19 |
| 3,913,442 | 10/1975 | Deutsch | 84/1.19 |
| 3,956,960 | 5/1976 | Deutsch | 84/1.19 |
| 3,992,970 | 11/1976 | Chibana et al. | 84/1.11 |

*Primary Examiner*—Robert K. Schaefer
*Assistant Examiner*—Vit W. Miska
*Attorney, Agent, or Firm*—Spensley, Horn & Lubitz

[57] ABSTRACT

In an electronic musical instrument of the class wherein the amplitude samples of a tone at successive sampling points of musical tone waveform are calculated by independently calculating respective partials that constitute the musical tone waveform and then adding the calculated partial samples, there are provided a "variable" generating circuit which generates a variable which varies with time, and a "variable" modifying circuit which modifies the variable with a coefficient corresponding to each partial thereby independently modifying the normal frequency of each one of the correponding partials in accordance with the output from the variable modulating circuit.

2 Claims, 4 Drawing Figures

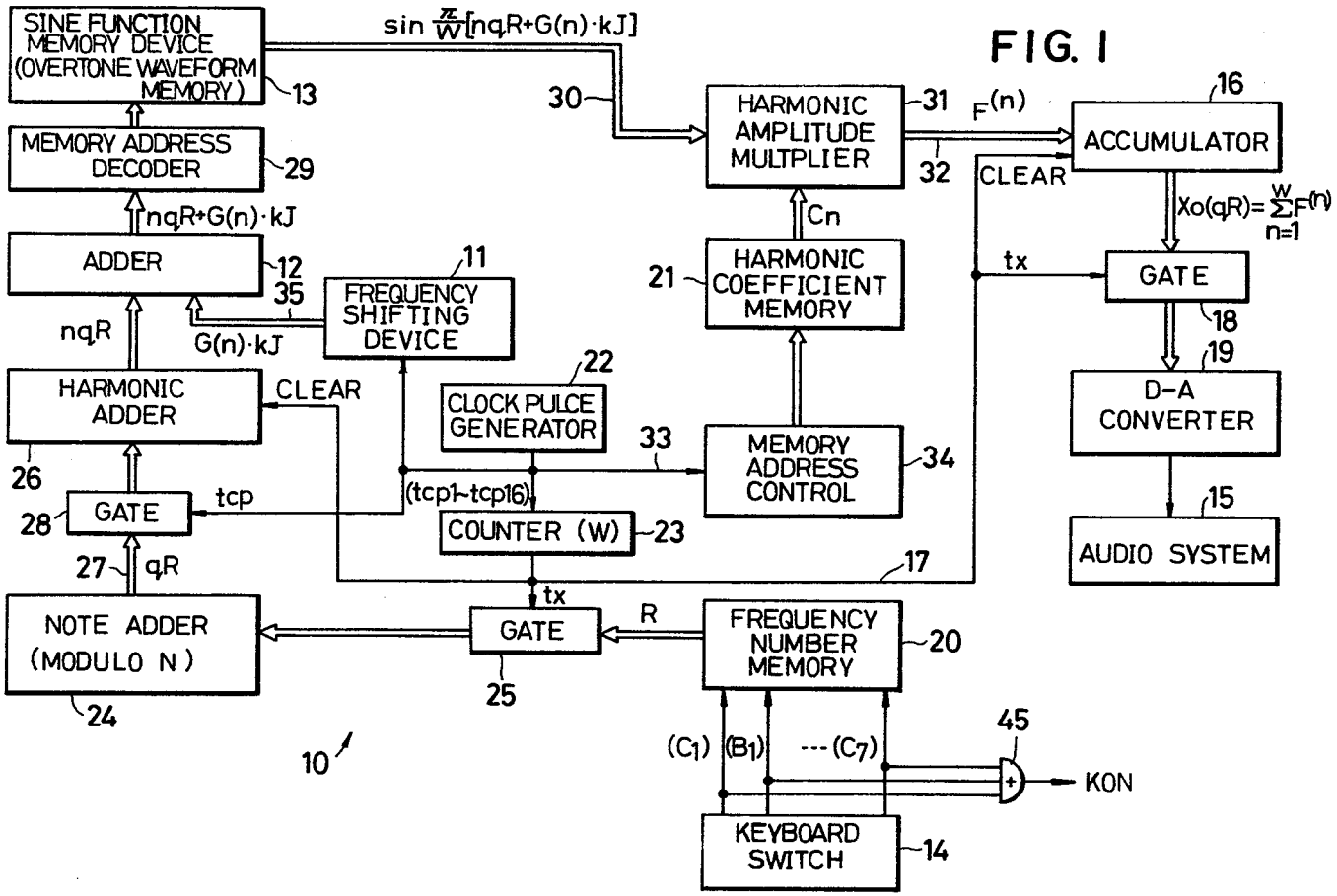
FIG. 1
ACCUMULATOR
16
Xo(qR)= Σ F(n) n=1 W
GATE
18
19
D-A CONVERTER
15
AUDIO SYSTEM
KON
45
F(n)
CLEAR
tx
31
32
HARMONIC AMPLITUDE MULTPLIER
Cn
HARMONIC COEFFICIENT MEMORY
21
34
MEMORY ADDRESS CONTROL
33
17
20
FREQUENCY NUMBER MEMORY
(C7)
(B1)
(C1)
14
KEYBOARD SWITCH
R
23
COUNTER (W)
22
CLOCK PULCE GENERATOR
(tcp1-tcp16)
tx
GATE
25
30
sin π/W [nqR+G(n)·kJ]
11
FREQUENCY SHIFTING DEVICE
CLEAR
10
13
SINE FUNCTION MEMORY DEVICE (OVERTONE WAVEFORM MEMORY)
29
MEMORY ADDRESS DECODER
nqR+G(n)·kJ
12
35
ADDER
G(n)·kJ
nqR
HARMONIC ADDER
26
tcp
GATE
28
27
qR
NOTE ADDER (MODULO N)
24

ELECTRONIC MUSICAL INSTRUMENT

BACKGROUND OF THE INVENTION

This invention relates to an electronic musical instrument adapted to generate anharmonic overtones.

The tone of a natural musical instrument generally contains overtone components which are not in a true harmonic relationship with respect to the fundamental wave component and such overtone components characterize the tone. An electronic musical instrument designed to generate such anharmonic overtones is disclosed in the specification of the U.S. Pat. No. 3,888,153. However, the invention disclosed herein has the following limitation in the anharmonic overtone of the tone generated. The Fourier component amplitude $F^{(n)}$ of the musical tone is calculated according to the following equation:

$$F^{(n)} = Cn \sin \pi/W\,(nqR + \upsilon\, Jq) \ldots (1)$$

where $n$ represents the order of the Fourier component, that is $n = 1, 2 \ldots w$, $Cn$ the amplitude coefficient of the Fourier component, $q$ time element which increases 1, 2, 3 . . . at a predetermined time interval, $R$ a value proportional to the fundamental frequency of the musical tone $\upsilon$ a value corresponding to the order of the Fourier component and being expressed by $\upsilon = n - 1$, and $J$ a constant thus the amount $[nqR]$ corresponding to the phases of the respective Fourier components having accurate harmonic relationship and the amount $[\upsilon jq]$ representing phase deviations for the respective Fourier components to realize resultant frequency deviations of the harmonics from the true harmonic relationship. Thus, anharmonic overtones are obtained by adding the deviation component $[\upsilon jq]$ to the true harmonic components. However, in this method, the element that determines the frequency deviation is only the constant $J$ and a relationship between frequency deviations of respective overtone components is always so that it is impossible to independently determine the amount of the frequency deviation of the respective overtones. In other words, as shown in Table 1, the fundamental wave has no deviation, the second harmonic has a deviation of $Jq$, and the amount of frequency deviation increases with the order of the harmonics.

Table I

| order of overtones n | amount of frequency deviation $\upsilon Jq$ | |
|---|---|---|
| 1 | (1 − 1) | Jq = 0 |
| 2 | | Jq |
| 3 | | 2Jq |
| 4 | | 3Jq |
| . | | . |
| . | | . |
| n | (n − 1) | Jq |

In other words, overtones of the higher orders always have larger frequency deviations than the overtones of the lower orders. Accordingly, with the method described above, the relationship in the anharmonic property between respective overtones (partials) is always constant so that there is limitation in the musical tone (anharmonic overtone) that can be produced.

SUMMARY OF THE INVENTION

It is an object of this invention to provide an improved electronic musical instrument wherein the amounts of the frequency deviation of respective overtones (partials) that make up a musical tone can be set independently for the respective overtones thereby producing extremely complicated anharmonics.

According to this invention, in an electronic musical instrument wherein the amplitude samples of respective overtones which constitute a musical tone wave are calculated at successive sampling points of the musical tone wave and the calculated amplitudes are added together the amplitude value $X_o(qR)$ at a sampling point (determined by $qR$) of the musical tone wave is obtained by the calculation according to the following equation:

$$X_o(qR) = \sum_{n=1}^{w} F^{(n)} = \sum_{n=1}^{w} C_n \sin \frac{\pi}{w}\,[nqR + G(n) \cdot kJ] \quad (2)$$

where $F^{(n)}$ represents the amplitude value of each overtone of the musical tone, $n$ the order of the overtone which is equal to 1, 2, 3 . . . $w$, $C_n$ the amplitude coefficient of the overtone, $q$ a time element which increases as 1, 2, 3 . . . at a predetermined time interval, $R$ a value proportional to the fundamental frequency of the musical tone, $G(n)$ coefficients having values $G(1)$, $G(2)$, $G(3)$ . . . corresponding to the overtones of respective orders which are used to independently set the amounts of frequency deviations of the respective overtones, $k$ a time element increasing 1, 2, 3 . . . at a predetermined time interval which is generally longer than the interval $q$, and $J$ a coefficient that determines the rate of frequency deviation. Accordingly, $(nqR)$ corresponds to the phases of the respective overtones ($n = 1, 2 \ldots w$) having accurate harmonic relationship.

In this case, it is possible to independently set the value of $G(n)$ at any value for the respective overtones so that the frequency deviation is set independently at any value for each overtone. It is thus possible to provide any complicated anharmonic relationship.

It is a feature of this invention that the variable $k$ is different from the variable $q$. For this reason, the equation (2) is not equal to the prior art equation (1). This is advantageous in that capacity of an operation circuit can be reduced as will be discussed later. In other words, the amount of frequency deviation is sufficiently small as compared with the normal overtone frequency so that the value of the frequency deviation $[G(n) \cdot kJ]$ is smaller than the value of the normal frequency $(n \cdot q \cdot R)$. If the resolution (precision) of the amount of deviation $(\upsilon\, Jq)$ is made to be dependent upon the variable $q$ as shown by equation (1) regarding the prior art, it is necessary to set the value of the constant $J$ at a small value. Since it is necessary to frequently calculate this value with a time interval of $q$, it is necessary to increase the capacity (bit number) of the operation circuit. On the other hand, when the resolution of the amount of deviation $(G(n) \cdot kJ)$ is made to be dependent upon a variable $k$ having a long interval as shown by equation (2) it is possible to reduce the operation capacity. In the following embodiment, the time element $q$ is set by a sampling point calculating timing pulse $tx$ where the time element $k$ is determined by a pulse $tm$.

If the frequency deviation coefficient $J$ is constant, the frequency deviation of each overtone does not vary with time. However, the coefficient can be made as a time function $J(t)$. If a frequency deviation coefficient $J(t)$ expressed by a function of time is used, it is possible to vary the frequency deviation of each overtone with time. In other words, it is possible to vary the anharmonic property of the musical tone with time. The frequency deviation coefficients $J$ and $G(n)$ differ from each other in that the coefficient $G(n)$ corresponds to each overtone whereas the coefficient $J$ is the same for all overtones.

In the equation (2), respective overtones $F^{(n)}$ are expressed as Fourier components (since functions). However, in this invention, the overtone is not always limited to a Fourier component but may be expressed by any function $f\{\ \}$ as shown by the following equation (3).

$$X_o(qR) = \sum_{n=1}^{w} F^{(n)} = \sum_{n=1}^{w} C_n f\left\{ \frac{\pi}{w} [nqR = G(n) \cdot kJ] \right\} \quad (3)$$

In this case, the sine function memory device shown in the following embodiment is replaced by a memory device for the function $f\{\ \}$. As the function $f\{\ \}$ may be used such functions as a saw tooth wave, a triangular wave and a rectangular wave.

According to this invention, there is provided an electronic musical instrument wherein the amplitude value of a tone at successive sampling points of a musical tone waveform is calculated by independently calculating the amplitude sample values of the respective overtones that constitute the musical tone waveform and then the calculated overtones are synthesized, and which instrument is characterized by a variable-generating circuit which generates a variable which varies with time, and a variable modifying circuit which modifies the variable with a coefficient corresponding to each overtone thereby independently deviating the normal frequency of each one of the corresponding overtones in accordance with the output from the variable modifying circuit.

Preferably, the variable-generating circuit comprises a circuit for generating a value $kJ$ which varies with time, and a circuit for modifying the period of the value $kJ$ with time, and the variable-modifying circuit comprises a circuit for generating frequency deviation coefficients $G(n)$ respectively corresponding to the orders $n$ of the overtones, and a multiplier that multiplies the variable $kJ$ with the coefficients $G(n)$.

BRIEF DESCRIPTION OF THE DRAWINGS

This invention can be more fully understood from the following detailed description taken in conjunction with the accompanying drawings in which;

FIG. 1 is a block diagram showing one embodiment of the electronic musical instrument of this invention;

DESCRIPTION OF THE PREFERRED EMBODIMENT

Figure 2:
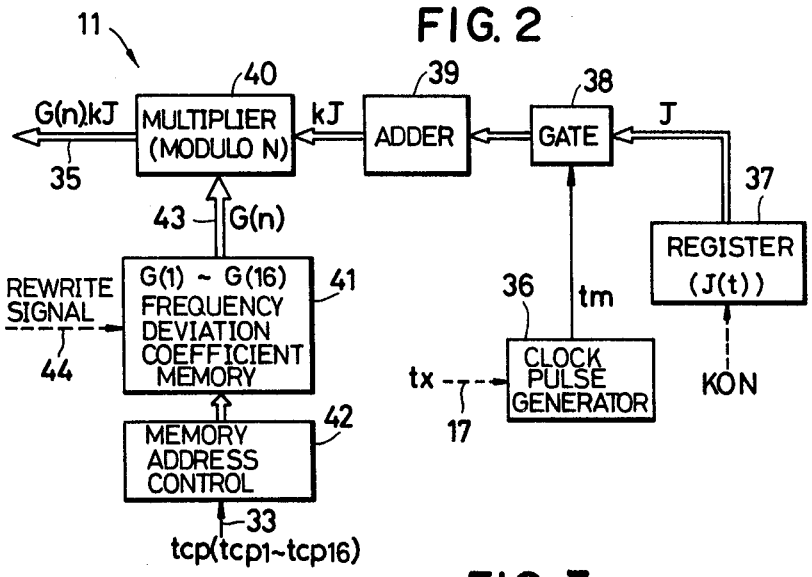
FIG. 2 is a block diagram showing the detail of the frequency shifting device, one of the essential elements of the embodiment shown in FIG. 1.

The circuit construction and operation of an electronic musical instrument 10 shown in FIG. 1 are identical with those disclosed in the specification of the U.S. Pat. No. 3,888,153 except that a frequency shifting device 11 and an adder 12 are added in the device according to the invention. The frequency shifting device 11 is shown in detailed in FIG. 2.

In the example shown in FIG. 1, a sine function memory device is employed as an overtone waveform memory device 13 and it is assumed that the instrument 10 produces a musical tone according to the equation (2). The instrument generates a musical tone selected by a keyboard switch 14 through an audio system 15. The musical tone is generated by independently calculating in the time divisional manner, the amplitudes values of respective overtones (in this example, the Fourier components) at successive sampling points of the waveform of the musical tone selected by the keyboard switch 14 and then algebraically adding the amplitude values of the overtone components by an accumulator 16. The sampling point amplitude obtained by the accumulator 16 is applied to a digital-analog converter 19 via a gate circuit 19 enabled by a sampling point calculating time pulse $tx$ on a line 17 whereby an analog voltage of said sampling point amplitude is applied to the audio system 15. Then the calculation of the sampling point of the next musical tone waveform is started. Thus, the sequential sampling point amplitudes of the musical tone waveform are calculated and generated one after in real time.

The period of the calculated waveform, that is, fundamental frequency of the tone to be generated is determined by the frequency number $R$ selected by the keyboard switch 14. A group of the frequency numbers $R$ corresponding to respective notes $C_1$ through $C_7$ are stored in a frequency member memory device 20. The tone color of a generated musical tone is determined by a group of higher harmonic coefficients $Cn$ stored in a memory device 21 and utilized to calculate the Fourier component at each sampling point. Generally, 16 Fourier components ($w = 16$) are sufficient to synthesize a musical tone.

The electronic musical instrument 10 executes the operation of the equation (2) by calculating the amplitude value $X_0(qR)$ for each sampling point with an interval $tx$. A discrete Fourier component amplitude $F^{(n)}$ for each of 16 components is calculated independently during contiguous time intervals $t_{cpl} - t_{cp16}$ determined by a clock pulse generator 22. During the first interval $t_{cpl}$, the amplitude $F^{(1)}$ of the fundamental wave (the first overtone) is calculated, and this value $F^{(1)}$ is applied to the accumulator 16. During the next interval $t_{cp2}$, the amplitude $F^{(2)}$ of the second Fourier component (that is, the second overtone) is calculated and added to the content of the accumulator 16. In the same manner, during the interval $t_{cp3}$, the third overtone amplitude $F^{(3)}$ is calculated and added to the accumulator 16. This operation terminates when all of W Fourier components are calculated at which time the algebraic sum contained in the accumulator 16 corresponds to the amplitude $X_o(qR)$ regarding a sampling point designated by the value of $qR$.

As above described, the waveform amplitude $x_o(qR)$ of the accumulator 16 is applied to the digital-analog converter 19 at the end of the calculating interval $tx$.

Then the accumulator 16 is cleared by a signal *tx* on line 17 thus commencing the calculation of the amplitude at the next sampling point. Thus, the value of $qR$ is increased and w overtone amplitudes $F^{(n)}$ are calculated at the sampling points designated by the new value of $qR$. In this manner, a desired waveform is formed and a musical tone of this waveform is produced through the audio system 15.

In the system shown in FIG. 1, a note adder 24 contains the value of $qR$ that identifies the sampling points. The value of $qR$ is increased at the commencement of each calculation interval *tx* by adding a selected frequency number $R$ to the existing content of the adder 24. The value of the selected $R$ is applied to the adder 24 via a gate circuit 25 which is enabled by a signal *tx* on line 17.

It is preferred that the adder has modulo N where N represents the product of the frequency number $R$ regarding any note and the number of the sampling points per one cycle of the waveform of the note. Preferably $N = 2w$.

The value of $nqR(n = 1, 2 \ldots w)$ which is necessary to calculate respective Fourier components is produced by a harmonic adder 26 which is cleared by a pulse *tx* at each sampling point amplitude calculating period.

At the time of generator of a first clock pulse $t_{cpl}$ of a new period, the value of the present $qR$ in the adder 24 is applied to the harmonic adder 26. Each time a clock pulse $t_{cp}$ is generated by the clock pulse generator 22, the value of $qR$ is added to the existing content of the adder 26. Consequently, the harmonic adder 26 contains a value $nqR$ regarding the $n$-th Fourier component now being calculated. It is also desirable that the harmonic adder 26 has modulo N.

To deviate the frequency, the normal phase data ($nqR$) of respective overtones ($n = 1, 2, 3 \ldots w$) are sequentially applied to the harmonic adder 26 and the adder 12 were they are added to the frequency deviation data $[G(n)kJ]$ of respective overtones applied with the same timing pulse (clock pulse $t_{cp}$). The output from the adder 12 $[nqR + G(n)\cdot kJ]$ is applied to a memory address decoder 29 having its output connected to a sine function memory device 13 from which the values of the Fourier components sin $(\pi/\mathrm{w})$ $[nqR + G(n)\cdot kJ]$ corresponding to respective overtones ($n = 1, 2, 3 \ldots 16$) are read out. The sine function memory device 13 comprises a read-only memory which stores digital values of amplitude values at successive sampling points of a sine wave in N addresses corresponding to the address inputs $[nqR = G(n)\cdot kJ]$ of modulo N.

Each of the sine wave amplitude values sin $(\pi/\mathrm{w})$ $[nqR + G(n)\cdot kJ]$ of respective overtones ($n = 1, 2, 3 \ldots w$) which are sequentially read from the memory device (at a timing of the clock pulse $t_{cp}$) is applied to a harmonic amplitude multiplier 31 over a line 30 where it is multiplied by the amplitude coefficient $Cn$ corresponding to the $n$-th overtone. The product represents the amplitude $F^{(n)}$ of the $n$-th overtone and is supplied to the accumulator 16 through a line 32. A suitable coefficient $Cn$ is read from harmonic coefficient memory device 21 by an address control device 34 to which is applied an overtone calculating timing pulses $t_{cp}(t_{cp1} - t_{cp16})$ over a line 33.

Frequency deviation data $[G(n)\cdot kJ]$ is supplied to the adder 12 from a frequency shifting device 11 over a line 35. In the frequency shifting device shown in FIG. 2, a clock pulse generator 36 produces a clock pulse *tm*. It is desirable that the clock pulse *tm* is of a lower rate (having a lower frequency) than the sampling point calculating timing pulse *tx* and that is should be generated in synchronism with a pulse *tx* of a certain order. Thus, it is advantageous to construct the clock pulse generator 36 such that the frequency of the clock pulse from line 17 is divided by M to obtain a pulse *tm*. Then, the period of pulse *tm* is $t_m = M\cdot tx$ ($M$ is any integer). A register 37 is provided which stores the frequency deviation coefficient $J$ (see the equation (2)) and repeatedly applies the coefficient $J$ to an adder 39 through a gate circuit 38 that is enabled at the timing of the clock pulse *tm*. The adder 39 holds the result of previous addition so that the coefficient $J$ is sequentially added to the previous result through the gate circuit 38. Accordingly, the output $kJ$ from the adder 39 increases gradually to $1J, 2J, 3J \ldots$ according to the clock pulse *tm* and is applied to a multiplier 40.

An overtone frequency deviation coefficient memory device 41 stores any desired frequency deviation coefficients $G(n) = G(1), G(2) \ldots G(16)$ corresponding to the orders ($n = 1, 2, 3 \ldots 16$) of respective overtones (in this example, the Fourier components) and the reading of the memory device 41 is controlled by a memory address control circuit 42 in response to an overtone calculation timing pulse $t_{cp}$ applied thereto through a line 33. In this manner, the frequency deviation coefficients $G(1), G(2), G(3) \ldots G(16)$ of respective overtones are sequentially read from the memory device 41 corresponding to the overtone calculating intervals $t_{cp1}, t_{cp2}, t_{cp3} \ldots t_{cp16}$ of the electronic musical instrument 10 and supplied to the multiplier 40 over line 43. Thus, the multiplier 40 calculates the product $[G(n)\cdot kJ]$ which is added to adder 12 over a line 35 to obtain $[nqR + G(n)\cdot kJ]$ at each overtone calculating interval $t_{cp1} - t_{cp16}$. Thus, signals $[qR + G(1)\cdot kT]$, $[2qR + G(2)\cdot kT] \ldots [16qR + G16 \cdot kJ]$ are sequentially produced.

The repsective overtone frequency deviation coefficients $G(1)$ through $G(16)$ can be of any desired values which are independent from one another. A group of frequency deviation coefficients $G(n)$ (which are $G(1)$ through $G(16)$) stored in the memory device 41 can be rewritten into another group of coefficients $G(n)$ by a signal applied to the memory device 41 over a line 44. Thus, it is possible to provide frequency deviation coefficients $G(n)$ having any values desired by a player.

Figure 3:
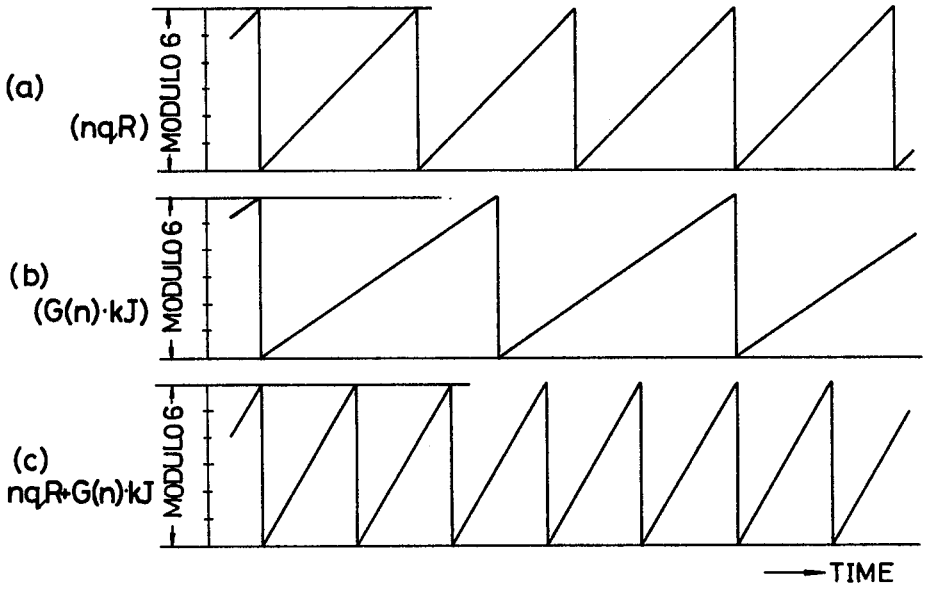
FIG. 3 is a graph for explaining that the modulo of the normal frequency component and that of variable data (phase data) of frequency deviation should coincide with each other, taking modulo 6 as an example.
Figure 4:
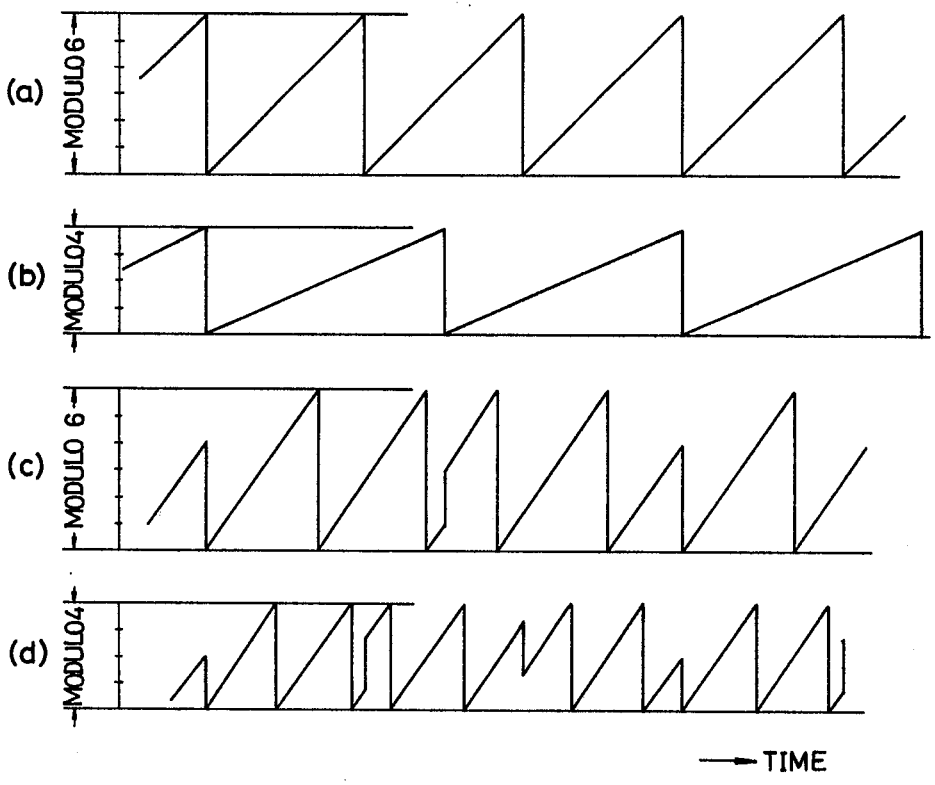
FIG. 4 is a graph for explaining that an erroneous operation will be resulted when the modulos of the variable data of the normal frequency component and of the frequency deviation component do not coincide, taking modulos 6 and 4 as the examples.

It is essential that the frequency deviation data $[G(n)\cdot kJ]$ should be the data represented by the same modulo N as the values nqR added by adder 12. The reason for this will be described in connection with the waveforms shown in FIGS. 3 and 4. When the data ($nqR$) of modulo 6 as shown in FIG. 3*a* is added to data $[G(n)\cdot kJ]$ of modulo 6 as shown in FIG. 3*b*, a sum $[nqR + G(n)\cdot kJ]$ having the same modulo 6 can be obtained as shown in FIG. 3*c*. Thus, it is possible to cause the output of the adder 12 to have the same modulo N. As has been pointed out hereinbefore, since the sine function memory device 13 has N addresses, it is possible to read out [sin $(\pi/\mathrm{w})$ $\{nqR + G(n)\cdot \mathrm{kJ}\}$] as contemplated. In FIG. 3*a*, where the frequency of ($nqR$) is 3, and when the frequency of $[G(n)kJ]$ of FIG. 3*b* is 2, the frequency of the sum $[nqR + G(n)\cdot kJ]$ is equal to 5. Thus, it will be clear that the frequency deviation data $G(n)\cdot kJ$ determines the amount of frequency deviation. On the other hand, as shown in FIG. 4, when data having a modulo 6 shown in FIG. 4*a* is added to data of modulo 4 shown in FIG. 4*b*, in other words when two data having different modulos are added together, where the result of addition is deemed as data having modulo 6 (FIG. 4*c*) or having modulo 4 (FIG. 4d), the sum varies quite irregularly. Thus, it will be clear that the two input data to the adder 12 should have the same modulo.

Since the variable $[G(n)\cdot kJ]$ must be represented by modulo N, it is necessary that the multiplier 40 should be constructed to have N modulos. In this example, when it is assumed that the variable $nqR$ has a modulo $N = 2w = 2 \times 16 = 32$, the multiplier 40 also has a modulo of 32. A multiplier having N (32) modulos can be fabricated readily. More particularly, the multiplier 40 is constructed such that it can produce on the output line 35 the products of upper five bits having weights of decimal 1 through 16 so that the output can vary over 32 values from binary "00000" to "11111", while one multiplier input $G(n)$ can be deemed as a constant, the other input $kJ$ is treated as a variable which varies with time. Although the adder 39 utilized to generate the variable $kJ$ seemingly requires bits of infinite number, the number of the bits is actually limited by the minimum value (excluding zero) of one input $G(n)$.

Assume now that the overtone frequency deviation constant $G(n)$ can assume 8 values of $0, 2^o, 2^{-1}, 2^{-2}, 2^{-3}, 2^{-4}, 2^{-5}$ and $2^{-6}$. In other words assume that any ones of these 8 values are assigned to 16 overtone frequency deviation coefficients $G(1)$ through $G(16)$ and that the frequency deviation coefficient $J = 1$. In other words, the output $kJ$ from the adder 39 increases as 0, 1, 10, 11, 100, 101 . . . each time a pulse $tm$ is applied. The values of the variable $kJ$ for respective values of the coefficient $G(n)$, when the multiplier 40 produces a maximum output "11111" (corresponding to decimal 31) are shown in the following Table 2.

Table 2

| | (MSB) | | | | kJ | | | | | | (LBS) |
|---|---|---|---|---|---|---|---|---|---|---|---|
| | | | | | | decimal weight | | | | | |
| G(n) | 16 | 8 | 4 | 2 | 1 | $\frac{1}{2}$ | $\frac{1}{4}$ | | . . . . . | | $\frac{1}{64}$ |
| $2^o$ | 1 | 1 | 1 | 1 | 1 | 0 | 0 | 0 | 0 | 0 | 0 |
| $2^{-1}$ | 1 | 1 | 1 | 1 | 1 | 1 | 0 | 0 | 0 | 0 | 0 |
| . | | | | | . | | | | . | | |
| . | | | | | . | | | | . | | |
| . | | | | | . | | | | . | | |
| . | | | | | . | | | | . | | |
| $2^{-5}$ | 1 | 1 | 1 | 1 | 1 | 1 | 1 | 1 | 1 | 1 | 0 |
| $2^{-6}$ | 1 | 1 | 1 | 1 | 1 | 1 | 1 | 1 | 1 | 1 | 1 |
| 0 | | | | | | | — | | | | |

More particularly, if the variable $kJ$ is "11111111111" when the coefficient $G(n)$ has a minimum value of $2^{-6}$ other than 0, the product $G(n)\cdot kJ$ is "11111000000" corresponding to decimal 31. Consequently, when the minimum value of the overtone frequency deviation coefficient $G(n)$ is $2^{-6}$, it is possible to make the multiplier 40 modulo 32 by making the number of output bits of the adder 39 required to produce a variable $kJ$ equal to 11 (that is, to use an adder of modulo 2048). For an overtone not provided with the frequency deviation, the coefficient $G(n)$ is made to be zero.

The content of the adder 39 increases with the timing of the clock pulse $tm$ which controls the gate circuit 38. Accordingly, for the purpose of obtaining frequency deviation data $G(n)\cdot kJ$ having the same content, it is necessary to decrease the value of coefficient $J$ as the frequency of the pulse $tm$ increases. Thus, when $q$ is used as the time element of the frequency deviation data as in the prior art method shown in the equation (1) (that is, when the gate circuit 38 is controlled by pulse $tx$) it is necessary to decrease the value of $J$ meaning that it is necessary to add a plurality of bits to the least significant bit of 11 bits which are effective to produce an output of modulo 2048 from the adder 39. It can be understood that, according to this invention, use of a clock pulse $tm$ slower than the sampling point calculation timing pulse $tx$ is effective to reduce the number of bits of the operation circuit.

While in the foregoing description, the frequency deviation coefficient has been treated as a constant, it is possible to use a time function $J(t)$ in place of $J$ as above described. In this case, the register 37 may be made of a type of function generator, more particularly, a memory device which is provided with a read control circuit and stores function $J(k)$. The output from the keyboard switch 14 is applied to an OR gate circuit 45 (FIG. 1) for producing a key-on signal KON from the OR gate circuit 45 when a key is depressed. This key-on signal KON is applied to a $J(t)$ memory device 37 (a register) and the read out address is advanced with the depression of the key thereby sequentially reading out the stored frequency deviation coefficients $(Jt)$. Accordingly, a value $G(n)\cdot kJ(t)$ is read out on a line 35 and the sampling point amplitude $X_o(qR)$ produced by the accumulator 16 has a value $$\sum_{n=1}^{w} Cn \sin \frac{\pi}{w} [nqR + G(n) \cdot kJ(t)]$$

In this manner, the variation in the value of the coefficient $J$ with the lapse of time after key depression means that the amount of frequency deviation of each overtone varies with time. For instance, it varies with the variation in the amplitude envelope of the volume of the musical tone such as an attack, decay, etc. As a consequence, a complicated anharmonic tone can be produced whose anharmonic property varies with time.

As above described, when the overtones calculated during each one of the overtone calculating intervals $t_{cp1}$ through $t_{cp16}$ of the electronic musical instrument 10 comprise waveforms $f\{\ \}$ other than the Fourier components, it is sufficient to simply substitute a sine function memory device 13 by an overtone waveform memory device storing other overtone waveform.

Thus, according to this invention, the amounts of the frequency deviations for respective overtones constituting a musical tone can be independently determined and, accordingly, any complicated anharmonic overtones can be produced as desired.

What is claimed is:

1. In an electronic musical instrument of the class wherein amplitude sample values of a tone at successive sampling points of a musical tone waveform are calculated by independently calculating sample values of respective partials that constitute said musical tone waveform and then adding the calculated partial values, the improvement which comprises:

a variable generating circuit which generates a variable which varies with time, and a variable-modifying circuit which modifies said variable with a coefficient corresponding to each partial thereby independently modifying the normal frequency of each one of the corresponding partials in accordance with the output from said variable modifying circuit, and wherein said variable-generating circuit comprises a circuit for generating a value $kJ$ which varies with time, and a circuit for changing the period of said value $kJ$ with time, and said variable modifying circuit comprises a circuit for generating frequency deviation coefficients $G(n)$ respectively corresponding to the order $n$ of said partials, and a multiplier that multiplies said variable $kJ$ with said coefficients $G(n)$ thereby modifying said period for respective partials such that the normal frequencies of respective partials are modified independently by amounts corresponding to the varied period of respective partial outputs $G(n)kJ$ from said multiplier.

2. An electronic musical instrument according to claim 1 wherein said multiplier is of the same modulo as the circuitry in said instrument which establishes said successive sample points at which said partials are independently calculated.

* * * * *